United States Patent [19]
Richartz
[11] Patent Number: 4,953,379
[45] Date of Patent: Sep. 4, 1990

[54] HOT-ROLLED STEEL BAR WITH HELICALLY EXTENDING RIBS, METHOD OF AND APPARATUS FOR PRODUCING THE STEEL BAR

[75] Inventor: Erich Richartz, Grafing B. Munich, Fed. Rep. of Germany

[73] Assignee: Dyckerhoff & Widmann Aktiengesellschaft

[21] Appl. No.: 262,454

[22] Filed: Oct. 25, 1988

[30] Foreign Application Priority Data

Oct. 31, 1987 [DE] Fed. Rep. of Germany ..... 3736942

[51] Int. Cl.[5] ..... B21H 3/00
[52] U.S. Cl. ..... 72/187; 72/198
[58] Field of Search ..... 52/737; 72/187, 194, 72/235, 198

[56] References Cited

U.S. PATENT DOCUMENTS

| | | | |
|---|---|---|---|
| 116,218 | 6/1871 | Prosser | 72/187 |
| 879,444 | 2/1908 | Crane | 52/737 |
| 2,089,311 | 8/1937 | Tolles | 72/235 |
| 3,653,246 | 4/1972 | Bock et al. | 72/198 |
| 3,722,249 | 3/1973 | Stosha et al. | 72/194 |
| 4,137,686 | 2/1979 | Kern | 52/737 |

FOREIGN PATENT DOCUMENTS

| | | | |
|---|---|---|---|
| 2337313 | 2/1974 | Fed. Rep. of Germany . | |
| 1784630 | 9/1974 | Fed. Rep. of Germany . | |
| 2843245 | 4/1980 | Fed. Rep. of Germany | 52/737 |
| 8255 | 2/1965 | Japan | 72/198 |

OTHER PUBLICATIONS

"Als Betonbewehrung dienender Spannstahl", Eisenwerk-Gesellschaft Maximilianshütte mbH. Sulzbach-Rosenberg Hütte, Apr. 30, 1964.

*Primary Examiner*—Lowell A. Larson
*Attorney, Agent, or Firm*—Toren, McGeady & Associates

[57] ABSTRACT

In the production of a hot-rolled steel bar, such as a concrete reinforcing bar, a continuous thread is formed on the bar. The thread is arranged so that an anchoring or connecting member with a female thread can be screwed onto the male thread formed on the bar. Initially, first ribs are hot rolled on the bar surface with the ribs located on opposite sides of the bar and extending only for a portion of the circumference of the bar. Immediately following the formation of the first ribs, second ribs are hot rolled extending between and interconnecting the first ribs whereby the first and second ribs form a continuous thread. The ribs are formed in a unit made up of adjacent roll stands, each containing two rolls, the axes of the rolls in one stand are offset by 90° to the axes of the rolls in the other stand. The rolls are interconnected so as to move together. The rolls in each roll stand form a roll gap with shaped surfaces on the rolls for defining the partial ribs forming the continuous thread.

5 Claims, 2 Drawing Sheets

HOT-ROLLED STEEL BAR WITH HELICALLY EXTENDING RIBS, METHOD OF AND APPARATUS FOR PRODUCING THE STEEL BAR

BACKGROUND OF THE INVENTION

The present invention is directed to a hot-rolled steel bar, such as a concrete reinforcing bar, to a method of producing such a steel bar, and to the apparatus for carrying out the method.

Hot-rolled ribbed concrete reinforcing steel bars are used for improving the composite action in concrete where the surface of the bar is provided with ribs forming a partial thread on which an anchoring or connecting member containing a corresponding internal thread can be secured. Based on the fundamental concept of the arrangement of such ribs, steel bars are known suitable for use as concrete reinforcing bars, particularly prestressing bars, where the ribs are located on two opposite sides of the circumference of the bar and extend only along a portion of the circumference of the bar, note DE-PS 17 84 630. Such steel bars can be rolled, in a normal hot rolling procedure, in the last rolling pass by means of a two-high roll pair where it is possible to adjust one of the rolls by rotating it around its axis relative to the other roll whereby determined locations on its circumference can be exactly positioned relative to corresponding locations on the circumference of the opposite roll when the rolls are driven at the same circumferential speed. In this manner, the ribs can be formed on the opposite sides of the steel bar with the ribs being located along a continuous helical line forming a screw thread.

Such steel bars can be used as concrete reinforcing bars if the shape and dimensions of the ribs correspond to the requirements of ribbed concrete reinforcing steel bars with regard to bonding characteristics. Further, such bars can be utilized as prestressing bars for a prestressed concrete structure, and also as anchor bars or rods for ground and rock anchors. Furthermore, such bars can be used as formwork ties or the like. This variety of uses is possible, since anchoring bodies can be screwed on at particular locations of the partial thread formed by the ribs. Such bars have the disadvantage that the anchoring and connecting members to be screwed on them for transmitting a predetermined bar strength must have a greater length than would be the case of a bar with a continuous uninterrupted thread.

SUMMARY OF THE INVENTION

Therefore, it is a primary object of the present invention to provide a hot-rolled steel bar for transmitting the bar strength into an anchoring or connecting member along a shorter distance than has been possible in the prior art. While a shorter steel bar is possible than has been available in the past, such a steel bar retains the advantages of the known steel bar, especially in that it can be produced in a continuous hot rolling process.

In accordance with the present invention, a steel bar, particularly for use as a concrete reinforcing bar, is formed with a continuous uninterrupted thread.

A steel bar with a continuous thread for use in reinforced concrete is known from DE-GM 1 905 704. On such a steel bar, the thread is produced by conventional thread-rolling machines. Such machines are so-called transverse rolling mills comprising two correspondingly shaped rolls rotating in the same direction. The steel bar is located between the rolls and rolls along between their circumferences, whereby, in addition to deformation, the steel bar experiences a rotational movement in the opposite direction and a forward feed in the initial screwing direction. In addition to being very time-consuming, this method has the disadvantage that it cannot be carried out in a continuous manner, particularly in connection with hot rolling, since the steel bar must execute a rotational movement for the formation of the thread.

By comparison, in accordance with the present invention, there is the advantage that the steel bar has a continuous uninterrupted thread affording the transmission of forces along the full length of the thread. Such a feature affords a considerable reduction in the length of the anchoring and connecting bodies, particularly in that the steel bar can be produced in a continuous longitudinal rolling procedure following the conventional rolling and can even be included as a part of the normal rolling procedure.

In the method embodying the present invention, for forming a continuous thread in a hot rolling operation, initially, ribs are formed extending only along a portion of the circumference of the bar with the ribs located on the opposite sides of the bar. In a second method step, immediately following the first step, additional ribs are formed extending along the circumferential regions of the bar located between the first ribs. The two method steps follow immediately after the rolling of the steel bar and utilize the rolling heat.

In carrying out the method of the present invention, the spacing of the ribs formed in the first step is less than the spacing of the ribs formed in the second step by an amount corresponding to the extension or lengthening of the steel bar in carrying out the method. The spacing of the ribs produced in the second step, in turn, is less than the spacing of the ribs in the final state of the bar by an amount corresponding to the final extension or increase in length of the bar.

In the hot rolling of steel bars, it has been known to locate ribs on opposite sides of the steel bar in the last rolling passes in consecutive working cycles, where the opposite sides are offset relative to one another by 90°, note DE-OS 23 37 313. Such a steel bar is used only as a concrete reinforcing bar, and the ribs act only to improve the bond with the concrete, that is, they do not require a predetermined ratio relative to one another. Instead, they can be located relative to one another as desired, it is only required that the ribs formed in a first working pass are not impeded by the rolls acting on the bar in a second working pass. To form the ribs, the rolls in the second working pass have recesses at the locations of the ribs formed in the first working pass. The rolls of the second working pass are formed as drag rolls, that is, they are not driven so that they follow the extension of the bar occurring in the first working pass in a simple manner.

The present invention is also directed to an apparatus for carrying out the method where the roll of two rolls stands or pairs where the roll stands are arranged one after the other and the roll axes of one stand are positioned offset relative to the rolls of the other stand by 90° about the axis of the bar being rolled. Such rolls form a roll gap with the surface of the rolls being shaped for forming the ribs. One roll of each pair is adjustable relative to the other roll. Further, one roll stand is adjustable relative to the other for adjusting the shape of the rolls.

The rolls in each stand are connected with one another so that they move together, preferably by means of a common gear unit. The rolls in one roll pair or stand in each instance, can be driven at the same circumferential speed, and the rolls in the different roll pairs or stands are driven at different circumferential speeds depending on the cross section of the bar to be rolled.

It is a significant feature of the invention that the rolls of each roll pair are adjustable relative to one another so that the ribs formed by the roll are located along a continuous helical line. Further, the rolls are connected to one another for common movement so that once the rolls are adjusted, the adjustment is not lost during the rolling process.

According to the process, and to the apparatus for carrying out the process, it is possible not only to produce steel bars with a continuous uninterrupted thread, but to provide these steel bars with ribs extending along a continuous helical line and formed so as to be interrupted, that is, in such a manner that anchoring members with right-handed threads as well as with left-handed threads can be threaded onto the ribs.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
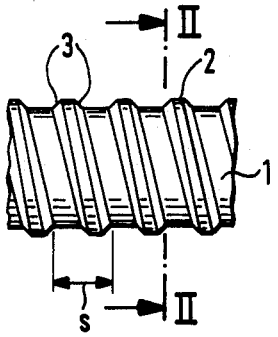
FIG. 1 is a partial side view of a steel bar embodying the present invention.
Figure 2:
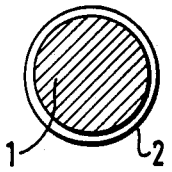
FIG. 2 is a cross-sectional view of the steel bar shown in FIG. 1, taken along the line II—II.
Figure 3:
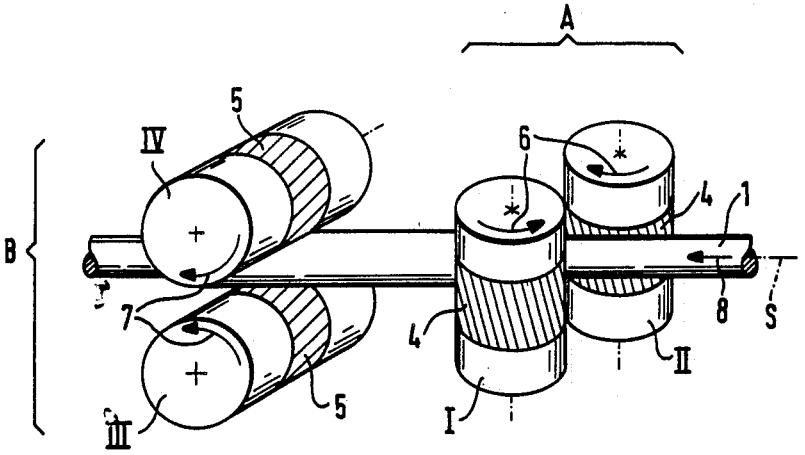
FIG. 3 is a schematic perspective view of a roll stand unit, in accordance with the present invention, comprising two-high roll pairs.

In FIG. 1, a steel bar 1 embodying the present invention is illustrated in a side view and a cross-section of the bar 1 is set forth in FIG. 2 with the section taken along the line II—II in FIG. 1. As can be seen in FIG. 2, the steel bar 1 has an approximately circular core cross section and is provided with ribs 2 extending helically about its surface. Ribs 2 form a continuous uninterrupted thread along the entire length of the bar. In the embodiment of the steel bar, shown in the drawing, the ribs have an approximately trapezoidal cross section with flanks 3 sloping inwardly toward one another in the direction extending radially outwardly from the core axis. Other thread cross sections can also be provided. Steel bar 1, embodying the present invention, is produced in a hot-rolling method, with the ribs being formed immediately as the bar exits the rolling heat, so that the last two roll stands of a rolling mill train form a unit for carrying out the method of the present invention with the unit shown schematically in FIG. 3.

In conventional rolling mill trains, the individual roll stands usually are spaced a greater distance from one another and the rolled steel is guided between adjacent roll stands along a curved path diverging from a rectilinear path, to compensate for possible differences in the rate of rotation of the separately driven roll stands. The roll stand unit, embodying the present invention, includes two two-high roll stands or pairs A and B arranged with a relatively small clear distance between them, for instance, 0.30 m. Each roll stand or pair A and B consists of two rolls I, II and III, IV, respectively. The rolls in the stand A are arranged so that they can be pivoted or offset by 90° about the axis of the bar S, note FIG. 3, in other words, the axes of the rolls I, II are rotated through 90° relative to the axis of the rolls III, IV. As a result, rolls I, II act on the opposite sides of the bar 1 with a vertical roll gap between them. The rolls III, IV act on the upper and lower surfaces of the bar 1 with a horizontal roll gap located between them. The rolls I, II have shaped surfaces 4 and the rolls III, IV have shaped surfaces 5 corresponding to the shape of the ribs 2 to be formed on the bar 1.

Rolls I, II and III, IV of the roll pairs A and B are connected to one another so as to move together. Such movement is effected in that the rolls I, II and III, IV are driven by a common gear unit acting on all rolls, such as by a "quattro" gear unit, or by connecting electronically different drives with one another. The rolls are driven in a synchronous manner within a pair to achieve the same circumferential speeds, that is, identical rates of rotation with identical roll diameters. The direction of rotation of the individual rolls within a pair is indicated by the arrows 6 and 7, respectively. As a result, it is assured that a ratio of the rate of rotation, once established, remains constant, that is, when the rate of rotation of one roll pair changes, the rate of rotation of the other roll pair must change correspondingly. The rate of rotation of the roll pairs A, B are different depending on the cross-sections of the bar 1 being rolled. It is advisable to carry out the rolling operation to provide tension in the bar, for example, the roll pair B located downstream in the feed direction through the rolling unit, that is, in the direction of the arrow 8 in FIG. 4, runs slightly ahead of the roll pair A in addition to the advance occurring due to the extension of the bar 1 in the roll stand A. The advance provided in the roll stand B as compared to the roll stand in A produces a tension force in the bar 1 located between the roll pairs or stands A and B.

In each of the roll pairs A and B, one of the rolls I or II, III or IV, respectively, must be adjustable relative to the other roll in the pair in the direction of rotation so that predetermined locations on the circumference of one of the rolls can be assigned to the corresponding places on the circumference of the other roll in accordance with position. This adjustability is necessary so that the partial regions of the thread ribs 1 produced by a roll pair extend along a continuous helical line. Further, a corresponding adjustability is required between the roll pairs A and B, whereby the two rolls of one of the roll pairs can be adjusted relative to the rolls of the other pair without changing their position relative to one another so that the partial regions of the thread ribs produced by means of the rolls are located on the same helical line as the partial regions formed by the two preceding rolls. Such a possibility is also provided when one of the four rolls is fixed and the remaining three rolls are adjustable with respect to the fixed roll.

Figure 4:
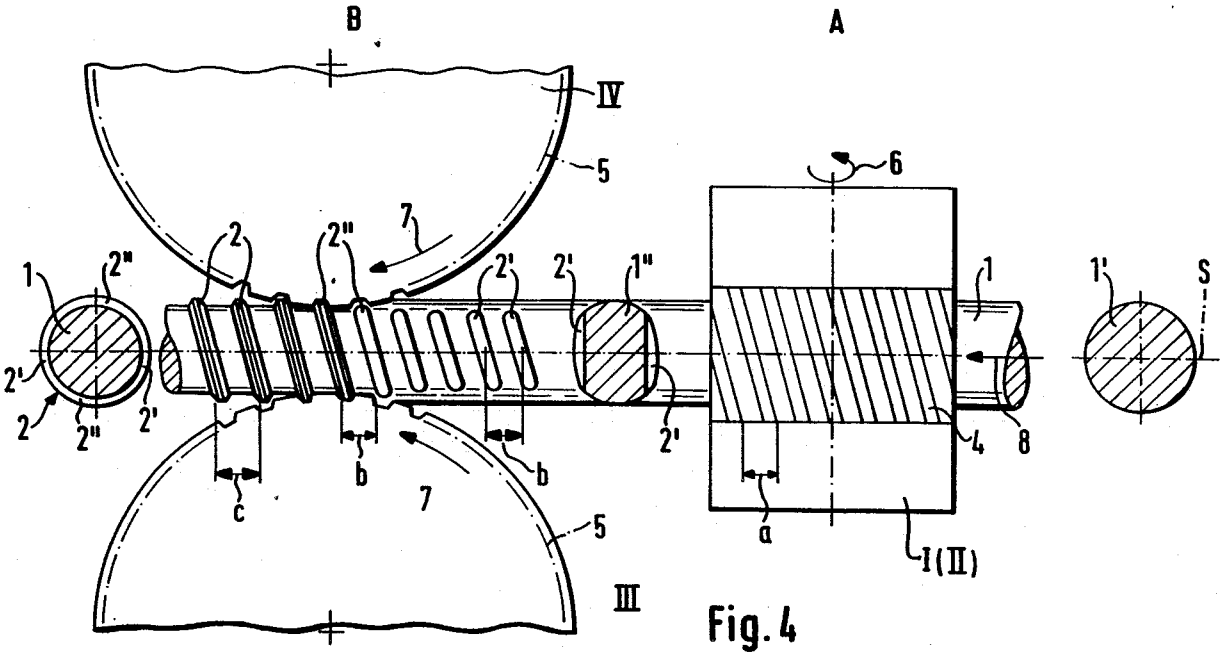
FIG. 4 is a perspective schematic view illustrating the individual steps performed in forming the steel bar in accordance with the present invention with the view being provided on an enlarged scale.

When fixing the rates of rotation of the two roll pairs A and B, particularly for controlling the ratio of the rate of rotation between the roll pair A made up of rolls I and II and the roll pair B made up of the rolls III and IV, the cross-sectional reduction of the steel bar must be taken into consideration during its passage through the respective roll gap, moreover, the cross-sectional reduction also effects the selection of the rib spacings in the individual operations, which can be explained by means of FIG. 4.

FIG. 4 displays, in a schematic side view, the two consecutively arranged roll pairs A and B with the rolls I, II, and III, IV, respectively, located along a path of travel in the direction of the arrow 8. Upstream from the roll pair A, steel bar 1 has an approximately circular cross section 1', shown only by way of example. Steel bar 1 has an approximately oval cross-section 1" between the roll pairs A and B with ribs 2' formed on two opposite sides of the bar by means of the shaped surfaces 4 on the rolls I, II. In addition to the ribs 2', upper and lower ribbed regions 2" are formed by the shaped surfaces 5 of the rolls III, IV after the bar 1 passes through the roll pair B. Due to the action of the roll pair B, the ribbed regions 2" provide a substantially circular shape for the bar with continuously circumferentially extending thread ribs 2 in the final condition of the bar. To achieve a defined spacing of the thread ribs 2 in the final condition of the steel bar 1, which spacing determines the pitch s of the thread, the spacing of the ribs in the individual rolling steps must be adapted exactly to one another and to the extension of the bar occurring in the rolling steps as the result of cross-sectional reduction. Accordingly, the rib spacing b, after the bar exits from the roll stand A and before it passes through the roll stand B, corresponds to the rib spacing a, provided by the roll pair A along with the extension of the bar 1 due to the cross-sectional reduction achieved in the roll stand A. The rib spacing produced by the roll stand B must correspond to the rib spacing b, and the spacing b is changed to the spacing c, the pitch s of the continuous thread in the finished product, due to the extension occurring in the roll stand B.

While specific embodiments of the invention have been shown and described in detail to illustrate the application of the inventive principles, it will be understood that the invention may be embodied otherwise without departing from such principles.

I claim:

1. A method of producing an axially elongated threaded steel bar, such as a concrete reinforcing bar, from a steel bar with a circular cross section comprising the steps of producing a continuous uninterrupted thread in a hot rolling operation, wherein initially hot rolling first ribs on a partial circumferential region on opposite sides of a bar with the ribs spaced apart in the circumferential direction and extending along a helical line, and immediately following formation of the first ribs hot-rolling second ribs extending along the helical line between and interconnecting the first ribs on opposite sides of the bar for providing a continuous helically extending thread made up of the first and second ribs, the hot rolling of the first and second ribs immediately follows the hot rolling of the steel bar and utilizes the rolling heat, the first ribs are formed in a first roll stand and the second ribs are formed in a second roll stand and a first axial spacing of the ribs formed in the first roll stand is less than a second axial spacing of the ribs in the second roll stand with the difference in spacing produced by the amount of extension of the steel bar in passing through the first roll stand to the second roll stand, and the second spacing is less than a final spacing of the ribs after exiting from the second roll stand by the amount of the extension of the steel bar due to its passage through the second roll stand, feeding the circular steel bar for forming the first ribs and shaping the circular steel bar so that it has an oval shape after the formation of the first ribs, and reshaping the steel bar in forming the second ribs so that the steel bar has a circular cross section after the formation of the second ribs with the first and second ribs forming the continuous thread.

2. Apparatus forming an axially elongated hot-rolled steel bar, such as a concrete reinforcing bar, with a continuous uninterrupted thread extending in the axial direction of said bar, comprising a roll unit in a hot rolling operation having an elongated rectilinear path of travel for a steel bar therethrough, said roll unit comprising a first roll stand and a second roll stand adjacent to one another and spaced apart in the direction of the path of travel, each said first and second roll stands utilizing the rolling heat of the hot rolling operation and comprising two rolls with the rolls of the first roll stand offset relative to the rolls of the second roll stand by 90° about the path of travel, each of said first and second roll stands forming a single roll gap with the rolls of each roll gap having shaping surfaces for forming spaced rib sections on the steel bar, and one of the rolls in each of said first and second roll stands being adjustable relative to the other roll in the same roll stand for adjusting the shaped surfaces of said rolls, said rolls of said first and second roll stands are interconnected so as to be driven together and are connected with one another by a gear unit.

3. Apparatus, as set forth in claim 2, wherein said rolls in said first roll stands are driven at the same circumferential speed and said rolls in said second roll stand are driven at the same circumferential speed.

4. Apparatus, as set forth in claim 3, wherein said rolls in said first roll stand are driven at a different circumferential speed relative to said rolls of said second roll stand as a function of the cross section of the bar being rolled.

5. Apparatus, as set forth in claim 2, wherein each of said rolls of said first roll stand have an axis of rotation extending vertically and each of said rolls of said second roll stand have an axis of rotation extending horizontally.

* * * * *